US005799879A

United States Patent [19]

Ottl et al.

[11] Patent Number: 5,799,879

[45] Date of Patent: Sep. 1, 1998

[54] DEVICE FOR PRODUCING A FLUID JET

[75] Inventors: Josef Ottl, Diedorf; Werner Kettl, Neusäss, both of Germany

[73] Assignee: Grafotec Kotterer GmbH, Diedorf, Germany

[21] Appl. No.: 574,302

[22] Filed: Dec. 18, 1995

[30] Foreign Application Priority Data

Feb. 13, 1995 [DE] Germany ..... 195 04 652.8

[51] Int. Cl.[6] ..... A62C 31/00

[52] U.S. Cl. ..... 239/437; 239/602; 239/DIG. 12; 118/257

[58] Field of Search ..... 239/437, 438, 239/602, DIG. 12; 118/257

[56] References Cited

U.S. PATENT DOCUMENTS 3,291,396 12/1966 Walter ..... 239/602
3,628,736 12/1971 Mowbray ..... 239/533
4,009,071 2/1977 Snellman et al. ..... 118/257
5,323,963 6/1994 Ballu ..... 239/63

*Primary Examiner*—Andres Kashnikow
*Assistant Examiner*—Lisa Ann Douglas
*Attorney, Agent, or Firm*—Harrison & Egbert

[57] ABSTRACT

In a device to produce a fluid jet (14), especially to apply glue (12) and/or a soft fluid (13) onto a web with a nozzle head (5) which bears a nozzle (6) provided with a discharge port (34) arranged at one end of a conduit (33) loaded with the fluid (12, 13), control of the fluid jet cross-section is achieved in a simple and low-cost, in that an elastic element (18) is provided for in the area of the discharge port (34), which features a through opening (17) communicating with the conduit (33) and which (18) is mounted between two compression elements (19, 20) which can shift in relation to each other.

10 Claims, 3 Drawing Sheets

1
2
3
4
5
6
7
8
9
10
11
12
13
14
27
p
p
p

DEVICE FOR PRODUCING A FLUID JET

TECHNICAL FIELD

The invention concerns a device to produce a fluid jet, especially to apply glue or a soft fluid onto a web with a nozzle head which bears a nozzle provided with a discharge port arranged at one end of a conduit loaded with the fluid.

BACKGROUND ART

With an application nozzle under the invention, precise and contact-free application of a glue trail onto a printing material, for example printed over in a printing press, is possible at a low cost compared to other application methods with a generic application nozzle. Two layers of the printing material can be glued together along a glue trail produced in that manner.

The properties of the printing material, especially paper, vary based on the desired print product. Low absorptive capacity of the glue, especially on smooth paper types, makes it so that when superimposing two layers of paper the glue in the paper plane is pressed apart and the glue trail unwantedly widened, when as a general rule a glue trail as narrow as possible should be produced. The fact that in addition the surface properties of a paper type are subject to variations over the lengths of individual paper rolls and that glue penetration also depends on the production speed, constitutes a problem.

In order to achieve a satisfactory narrow glue trail for a given production, a nozzle with a suitable discharge diameter must be selected and installed from a series of nozzles of various discharge diameters kept available. In addition to the assembly cost, it is also particularly inconvenient that production must then be stopped, which is rather costly based on the downtime and on the waste paper generated when starting up the printing press.

A further problem presented by the known designs is that the optimum nozzle discharge port diameter often becomes evident only during production, especially when changing the production speed.

SUMMARY OF THE INVENTION

The purpose of the invention is to make control of the cross-sectional area of the fluid jet, especially in the form of glue or soft fluid, possible with devices as simple and as cost-efficient as possible.

This purpose is achieved in a surprisingly simple and efficient manner, in that an elastic element is provided for in the area of the discharge port, which features a through opening communicating with the conduit and which is installed between two compression elements movable in relation to each other.

With the arrangement according to the invention, it is possible to change the fluid jet diameter by changing the through opening diameter of the nozzle without replacing the nozzle and without stopping the printing press to replace the nozzle. In addition, it is no longer necessary to keep several nozzles of different discharge port diameters available.

Furthermore, the nozzle can be completely closed through compression of the elastic element so that an otherwise necessary shutoff valve is eliminated. System flushing can be carried out upon full closure with the elastic component, during which the glue or the soft fluid present in the line can be flushed into the collecting container.

The nozzle can also be flushed in a satisfactory manner in a very short time with the nozzle fully open because of the large outlet section and flushing times below one second can be achieved. The flushing waste is thus significantly reduced. It is also possible to safely carry out the flushing when driving down the printing press within the drive-down time frame, while on conventional systems the flushing process cannot be completed safely within the time available upon fast drive-down so that in certain conditions part of the flushing liquid cannot be removed from the web which causes corrosion of the printing press parts.

The continuous adjustability of the through opening diameter in the nozzle is especially advantageous since the fluid jet diameter can thus be adjusted precisely and steplessly to the given conditions, and readjustment during the course of the production is also possible.

Especially advantageous embodiments of the invention result from the subclaims.

The elastic element is preferably made of a rubber material with high rebounding elasticity as it thus returns to its original position after elastic deformation and also achieves high service life even with frequent or long-lasting deformation. A material with a Shore hardness degree of 60–80 has proven especially suitable.

According to a preferred embodiment, the material consists of polyurethane as this material allows for a fluid jet which can be controlled very precisely.

The elastic element has preferably an annular shape which allows for a change of the jet diameter which is even over the whole cross-section. An annular element is also easy to manufacture and to install in the nozzle. The design of the elastic element with orthogonal section is also particularly suitable since the ring can thus adjust the diameter of the through opening with high precision.

In addition, it is an advantage if at least one outside face of the ring sits against the inside of a compressing element. The direction into which the material shifts upon elastic deformation is thus precisely defined.

According to a preferred embodiment of the invention, a thrust bolt rigidly mounted in the nozzle head and a hollow outside cylinder movable in relation to the former are provided as compression elements. This assembly can be mounted in a simple and space-saving manner in the nozzle head and can move safely.

The outside cylinder is provided with a collar sitting against the elastic element and extending inward so that between said collar and the thrust bolt the elastic element can be deformed in a reliable and precise manner.

In addition, the hollow outside cylinder is preferably connected to an adjusting device via adjusting rods extending in an axial direction. This sturdy arrangement allows in a simple manner for a very accurate and low-wear transmission of the adjustment onto the compression elements.

For a torsion-proof design it is also an advantage that the adjusting rods are mounted in holes made in a housing.

The design of the adjustement device as an adjusting piston is also suitable as this allows for a simple, cant-proof adjustment process.

The unilateral pressurization of the adjusting piston with compressed air is especially low-wear and efficient.

In addition, a stop is preferably provided, through which axial movement of the adjusting piston can be limited in a simple and reliable manner. The stop can be positioned so as to be able to define the range within which the section of the average opening can be changed by regulating the deformation range.

In order to allow in the simplest and most cost-efficient manner for the restoring of the movable compression element, a return spring is provided.

BRIEF DESCRIPTION OF THE DRAWINGS

Other features and advantages result from the description of two exemplary embodiments based on the drawing, which shows the following.

DETAILED DESCRIPTION OF THE INVENTION

Figure 1:
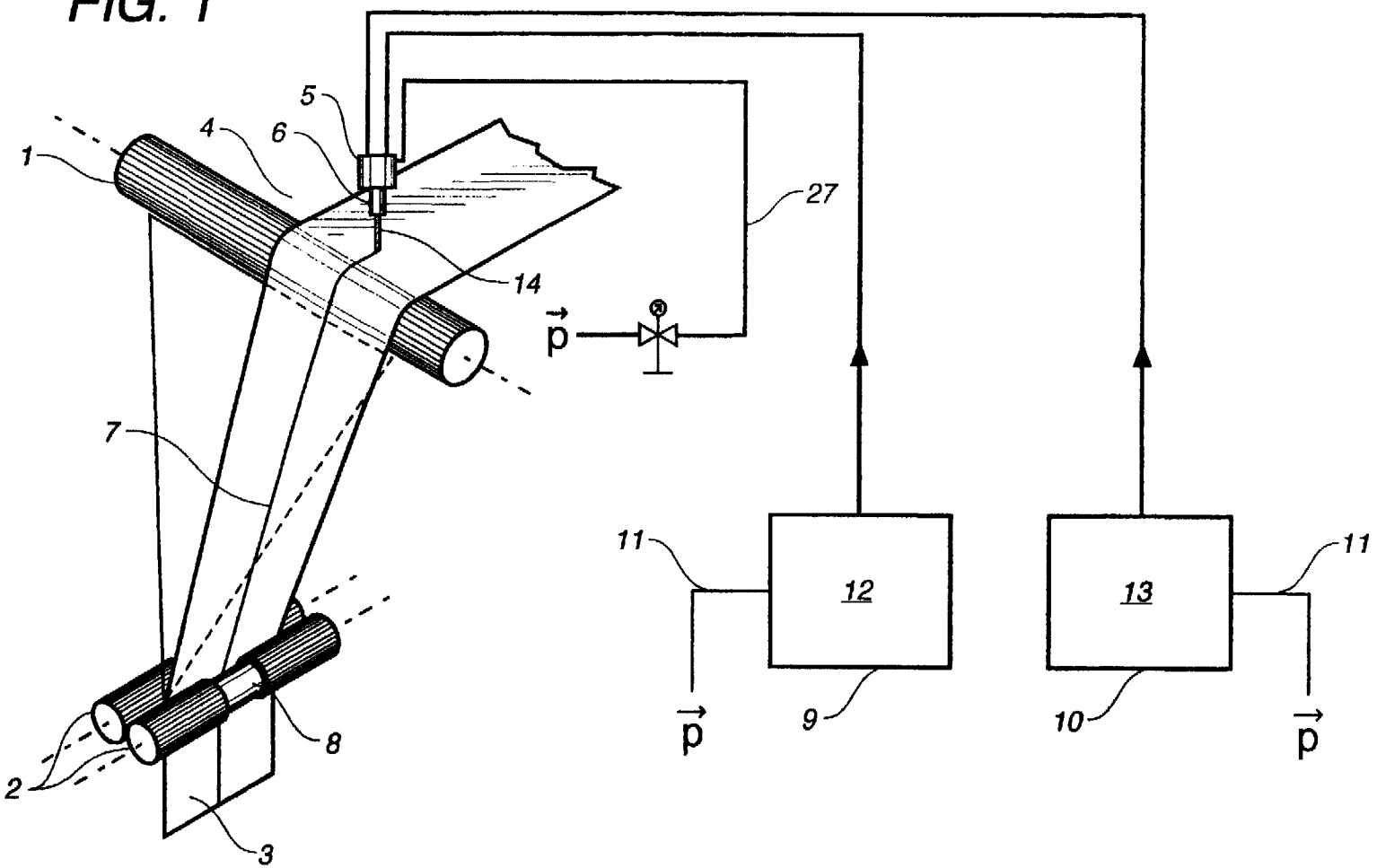
FIG. 1 a schematic representation of a glue application device according to the invention, mounted in a printing press FIG. 2 a cut representation of an embodiment example of a nozzle head with a nozzle to produce a fluid jet FIG. 3 an additional nozzle.

FIG. 1 shows a printing material web 3 running to a couple of feed rolls 2 via a guide roller 1 mounted in a roller rotary printing press, onto which a glue or soft fluid trail 7 is applied with a glue and soft fluid application device 4 featuring a nozzle head 5 with a nozzle 6, in whose area the feed rolls 2 feature peripheral notches 8 to avoid contact between them and the glue or fluid trail 7.

The glue and soft fluid device 4 is fed either glue 12 or soft fluid 13 from a pressurized glue storage container 9 or from a soft fluid storage container 10.

The glue 12 or the soft fluid 13 are applied contact-free onto the printing material web 3 through a fluid jet 14 with adjustable cross-section, coming out of nozzle 6.

Figure 2:
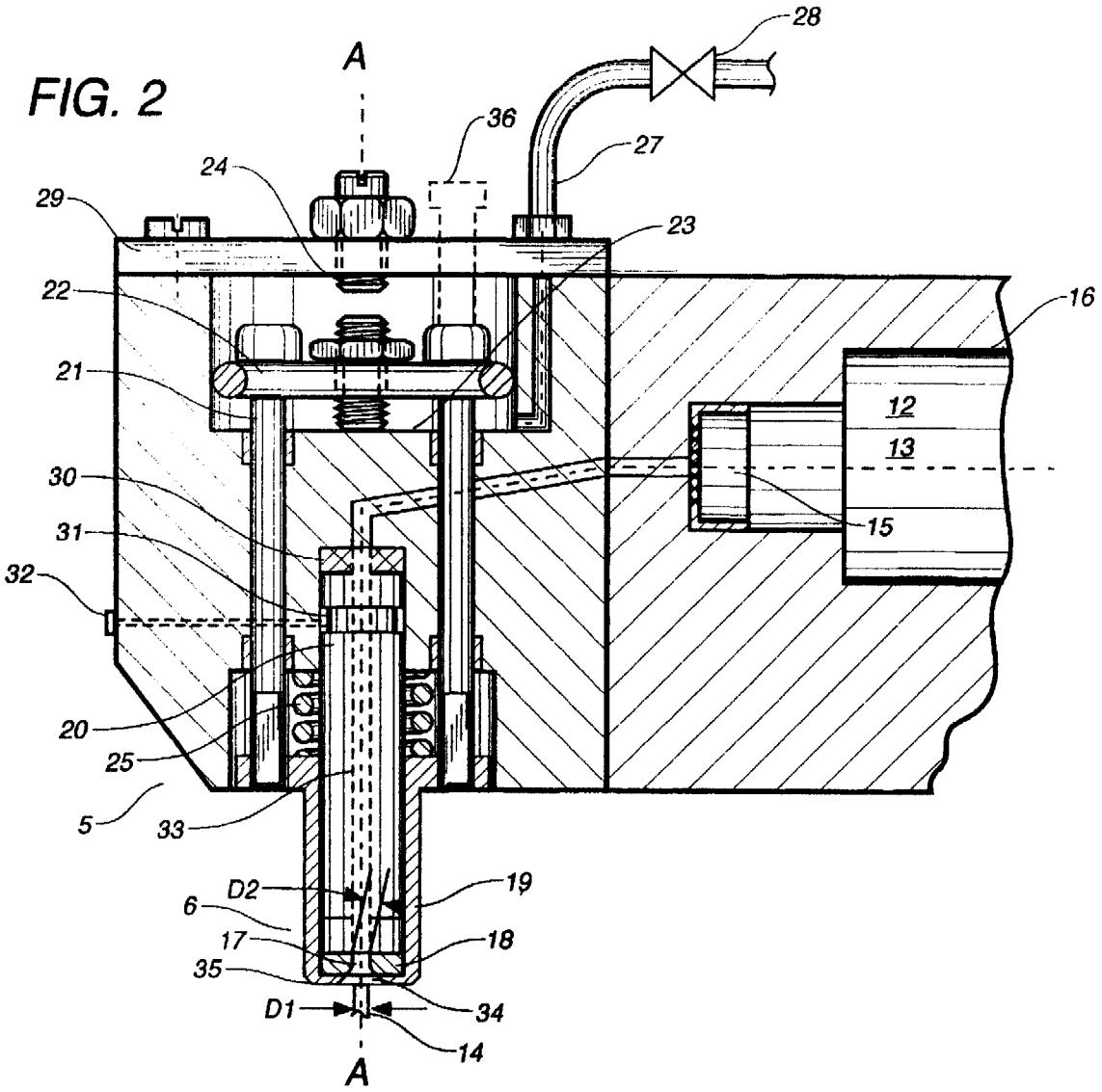

FIG. 2 clarifies the construction of nozzle head 5. The nozzle 6 mounted in nozzle head 5 is fed glue 12 or soft fluid 13 via a supply line 16 which can be closed with shutoff valve 15; the glue or soft fluid running through conduit 33 up to the discharge port 34 where it exits the assembly as a fluid jet 14.

To adjust the cross-section of diameter D1 of the fluid jet 14, diameter D2 of the through opening 17 located approximately above the discharge port 34 can be reduced by compressing the elastic annular-shaped element 18 in an axial direction A—A through two abutting compression elements 19 and 20, so that the material shifts inward in an approximately radial direction and the through opening 17 designed as a recess of the annular elastic element 14 narrows. The through opening 17 can also be formed beside an elastic element, between an elastic and a firm element or between several elements. The elastic element is made of rubber material with high rebounding elasticity, such as polyurethane, silicone or equivalent, with a Shore hardness of preferably 50–80. It is deformed only in the elastic area.

A gasket 31 is provided to prevent glue 12 or soft fluid 13 from leaking out.

The rigid fixed mounting of the thrust bolt 20 in the nozzle head housing is achieved here through a headless set screw 32 (shown in broken line fashion) engaging into notch 31.

Compression of the elastic element 18 is achieved through an overlaid relative motion of the outside cylinder 19 and of the thrust bolt 20 mounted therein. In the shown arrangement, the movable outside cylinder 19 moves in relation to the thrust bolt 20 mounted rigidly in nozzle head 5. As an alternative, a rigid mounting of the outside cylinder 19 and movable mounting of thrust bolt 20 are also possible.

The outside cylinder 19 is moved in relation to the thrust bolt 20 via several adjusting rods 21 running in an axial direction. Adjusting rods 21 run parallel to axis A—A in recesses extending in the housing of the nozzle head 5, which makes the assembly torsion-proof.

Adjusting rods 21 can be moved via a suitable adjusting device, here via an adjusting piston 22 connected with them.

The motion of the piston is limited downward through stop face 23 and upward through stop 24, whereby the stop 24 is designed as an adjusting screw and therefore can be positioned as needed.

A return spring 25 in the form of a compression spring is provided for the return of the adjusting piston 22 and therewith of the compression elements 19 and 20 compressing elastic element 18.

The adjusting piston 22 is mounted in a bore in the nozzle head housing.

The motion of adjusting piston 22 can be achieved in various manners, such as for example through a solenoid, etc. The adjusting piston 22 can be lifted by introducing compressed air into chamber 26 until it hits stop 24. The outside cylinder 19 is thus lifted via the adjusting rods 21 and presses the elastic element against thrust bolt 20 while reducing the cross-section D2 of through opening 17.

Compressed air supply is achieved via indicated (also in FIG. 1) compressed air line 27. Compressed air adjustment is possible via a compressed air valve 28 whose actuation can be performed from a control station or panel. The main advantage of using compressed air versus electrically operated adjusting devices lies in the fact that in this manner ignition of the glue or more specifically of the gases escaping therefrom is not to be feared, which significantly increases the reliability of the unit.

As an alternative to the represented and above-described embodiment, the configuration of the adjusting rods 36 (shown in broken line fashion) extending through the wall is also possible. Positioning of the adjusting rods 36 and regulation of the cross-section of the through opening 17 can then be carried out through a control device or manually.

In place of the annular elastic element with approximately orthogonal cross-section 18 shown herein, another preferred embodiment of the elastic element 18 is also possible. In addition to the annular design, any embodiment is especially advantageous, in which the outside surface of the elastic element 18 sits at least partially against the inside surface of the outside cylinder.

The elastic element can also include several components and the cross-section of the through opening 17 can be reduced in another manner than the symmetrically radial manner described herein.

Figure 3:
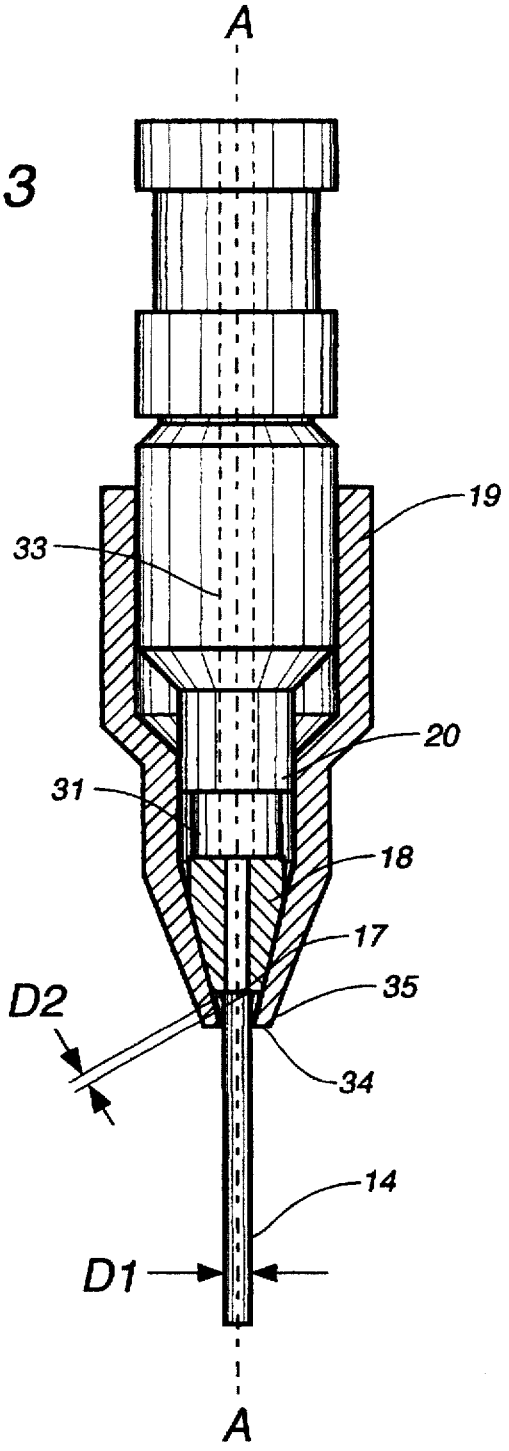

FIG. 3 shows a basically conical embodiment of elastic element 18. The collar 35 of outside cylinder 19 which presses against elastic element 18 runs inward in an oblique radial direction while the counter pressure of the thrust bolt 20 acts upon the elastic element 18 also here in the direction of axis A—A. The narrowing of the through opening 17 is then partly due to a displacement of the elastic element inward in an oblique radial direction, i.e., parallel to the inside wall of the collar 35 of outside cylinder 19 also running inward in an oblique radial direction, under elastic deformation of the elastic element 18.

In addition, compression elements 19 and 20 can be designed differently from than those represented. For example, it is possible to use two compression pistons in an outside cylinder, which can move in relation to each other and which compress the elastic element 18 between themselves. Embodiments are also possible, in which the compression elements do not run in a common outside cylinder.

We claim:

1. A fluid jet device for applying a line of glue or soft fluid from a conduit onto a web comprising:

a nozzle head bearing a nozzle having a discharge port positioned adjacent an end of the conduit;

a ring-shaped elastic element positioned within said nozzle adjacent said discharge port, said elastic element having a bore-shaped through opening communicating with the conduit;

compression means positioned within said nozzle head, said compression means for exerting a compression force onto said elastic element so as to change a diameter of said through opening and a diameter of the line passing through said elastic element from the conduit, said compression means comprising:

a thrust bolt rigidly mounted in the nozzle head and having a surface abutting a surface of said elastic element; and a hollow outside cylinder movable in relation to said thrust bolt, said outside cylinder having an inwardly extending collar abutting another surface of the elastic element, said hollow outside cylinder being connected by adjusting rods to an adjustment means, said adjustment means for selectively moving said outside cylinder relative to said thrust bolt so as to compress said elastic element therebetween.

2. The device according to claim 1 wherein the elastic element is made of a rubber material with high rebounding elasticity.

3. The device according to claim 2 wherein the elastic element is made of material with a Shore hardness degree of 60–80.

4. The device according to claim 2 wherein the elastic element is made of polyurethane.

5. The device according to either claim 1 wherein said another surface is an outside face of said elastic element, said outside face abutting an inside surface of inwardly extending collar.

6. The device according to claim 1 wherein the adjusting rods are mounted in holes formed in said nozzle head.

7. The device according to claim 1, said adjustment means further comprising an adjusting piston mounted in a bore formed in the nozzle head, said adjusting piston being connected to said adjusting rods.

8. The device according to claim 7, said adjusting means further comprising:

a pneumatic line communicating with said bore such that the adjusting piston is movable through unilateral pressurization with compressed air through said pneumatic line.

9. The device according to claim 8, said adjusting means further comprising:

a stop member extending into said bore in an area adjacent said adjusting piston so as to limit an axial movement of the adjusting piston.

10. The device according claim 1 said compression means further comprising:

a return spring positioned in said nozzle head and acting on said outside cylinder.

* * * * *